United States Patent [19]

Bacrania

[11] Patent Number: 4,608,530

[45] Date of Patent: Aug. 26, 1986

[54] PROGRAMMABLE CURRENT MIRROR

[75] Inventor: Kanti Bacrania, Palm Bay, Fla.

[73] Assignee: Harris Corporation, Melbourne, Fla.

[21] Appl. No.: 669,788

[22] Filed: Nov. 9, 1984

[51] Int. Cl.[4] ..... G05F 3/20

[52] U.S. Cl. ..... 323/315; 323/351

[58] Field of Search ..... 323/315, 316, 317, 351; 307/296 R, 297

[56] References Cited

U.S. PATENT DOCUMENTS

| | | | |
|---|---|---|---|
| 3,743,850 | 7/1973 | Davis | 323/315 |
| 3,761,787 | 9/1973 | Davis et al. | 307/299 B |
| 3,982,172 | 9/1976 | van de Plassche | 323/317 |
| 4,210,875 | 7/1980 | Beasom | 330/261 |
| 4,241,315 | 12/1980 | Patterson, III et al. | 330/261 |
| 4,280,091 | 7/1981 | Hiltner | 323/315 |
| 4,306,246 | 12/1981 | Davies et al. | 357/36 |
| 4,408,190 | 10/1983 | Nagano | 323/315 |

OTHER PUBLICATIONS

H. Remschardt et al., "Tolerance Trimming of Electrical Data of LSI Semiconductor Circuits" IBM Technical Discl. Bulletin, vol. 20, No. 8, Jan. 1978, pp. 3189–3190.

*Primary Examiner*—Peter S. Wong

*Attorney, Agent, or Firm*—Barnes & Thornburg

[57] ABSTRACT

Compensation for a reference current is provided using a current mirror which has programmable controlled legs which vary the ratio of the input reference current and the output reference current. The input reference current is measured without activating the current mirror and the controlled legs are programmed to provide the desired ratio. The parallel connected programmable controlled legs have a binary weighted current capacity.

10 Claims, 2 Drawing Figures

| I Ref. Out / I Ref. In | F5 | F4 | F3 |
|---|---|---|---|
| $\frac{n+7}{n}$ | 0 | 0 | 0 |
| $\frac{n+6}{n}$ | 0 | 0 | 1 |
| $\frac{n+5}{n}$ | 0 | 1 | 0 |
| $\frac{n+4}{n}$ | 0 | 1 | 1 |
| $\frac{n+3}{n}$ | 1 | 0 | 0 |
| $\frac{n+2}{n}$ | 1 | 0 | 1 |
| $\frac{n+1}{n}$ | 1 | 1 | 0 |
| 1 | 1 | 1 | 1 |

1 = BLOWN FUSE
0 = INTACT FUSE

PROGRAMMABLE CURRENT MIRROR

BACKGROUND AND SUMMARY OF THE INVENTION

The present invention relates generally to reference current circuits and more specifically to an improved programmable reference current circuit.

A reference current on an integrated circuit typically has a tolerance of ±20%. Many complicated circuits are provided to assure a reference current which is indepenent of voltage supply, temperature, processing variations and other physical as well as environmental characteristics. Similarly, adjustability using variable resistance and/or laser trimming have been suggested.

It is an object of the present invention to provide a unique reference current circuit which is programmable.

Another object of the present invention is to provide a reference current circuit which is readily programmable without sophisticated equipment or processing time.

These and other objects of the invention are attained by providing a current mirror which receives the actual reference current and is programmable to provide the desired reference current as a function of the actual reference current. The current mirror includes a controlled leg having a transistor and a plurality of controlling legs including a plurality of parallel connected transistors in a current mirror configuration. In addition to the primary controlled transistor, a plurality of secondary control transistors are connected with a programming element in its current path. The method of programming includes measuring the input reference current in the controlling leg and programming the individual secondary controlled legs to provide a desired output reference current which is a function of the input reference current. By controlling the current handling capacity of the plurality of controlled legs, the desired output reference current is provided. A diode is provided between the reference input current and the controlling transistor such that the input reference current can be measured without activating the current mirror. The programming of the secondary controlled legs is achieved by a programming terminal for each of the secondary legs used in combination with a reference terminal of the current mirror. Preferably, the current capacity of the controlling leg and the primary controlled leg are equal whereas the current capacity of the secondary controlled legs have a binary weighted current capacity.

Other objects, advantages and novel features of the present invention will become apparent from the following detailed description of the invention when considered in conjunction with the accompanying drawings.

DETAILED DESCRIPTION OF THE DRAWINGS

Figures 1, 2:
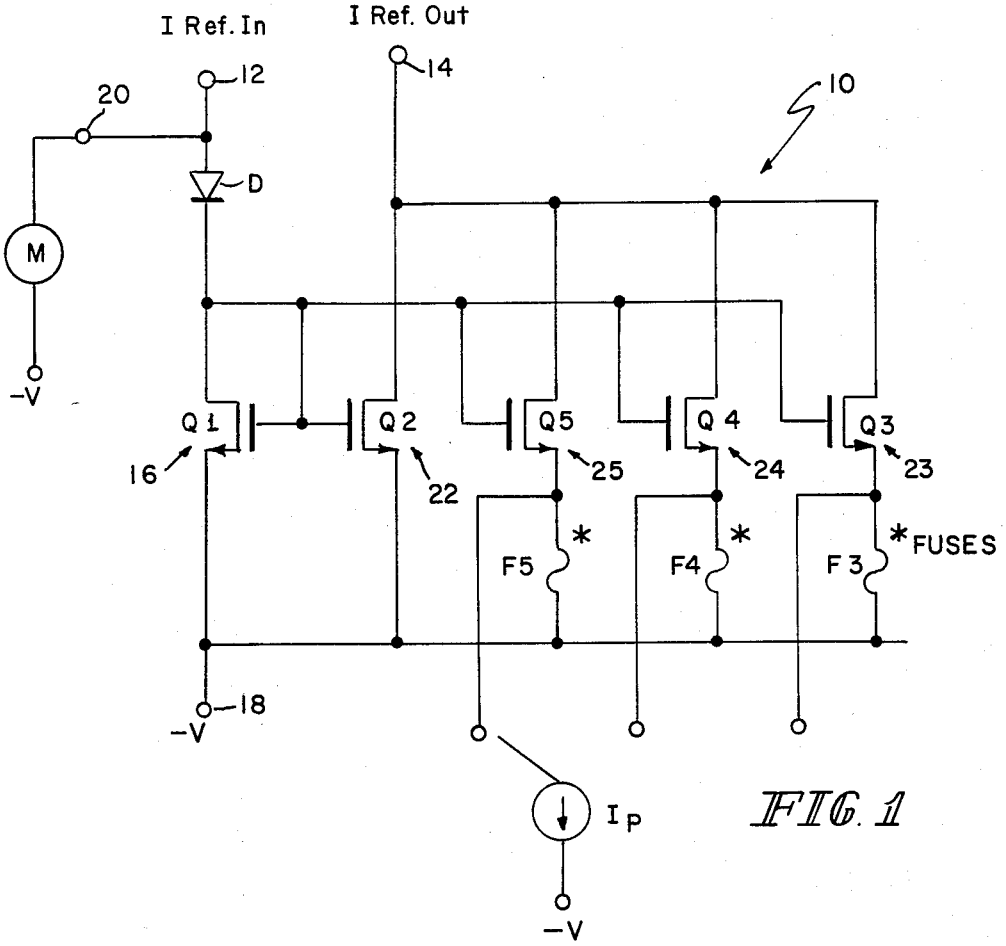
FIG. 1 is a schematic of a current mirror incorporating the principles of the present invention.
FIG. 2 is a table illustrating the relationship between the current ratio of the current mirror and the programming states of the programmable legs.

A current mirror 10 as illustrated in FIG. 1 includes an input terminal 12 receiving reference input current $I_{REFIN}$ and an output terminal 14 providing an output reference current $I_{REFOUT}$. The controlling leg 16 of the current mirror 10 includes a controlling transistor $Q_1$ having a current path connected in series with the input terminal 12 and a reference terminal 18. In series with the current path of $Q_1$ is a diode D. A sensing or measuring terminal 20 is provided between the current input terminal 12 and the diode D and which may be connected a current meter M as shown. The meter M is not part of the present circuit and is connected only during a measurement. The controlled legs 22, 23, 24 and 25 of the current mirror 10 each include a transistor $Q_2$, $Q_3$, $Q_4$ and $Q_5$ respectively having their current paths connected between the output current terminal 14 and the reference terminal 18. The control terminals of the transistors $Q_2$, $Q_3$, $Q_4$ and $Q_5$ are connected to the control terminal of transistor $Q_1$ of the controlling leg. A transdiode connection connects the control terminals of the transistors to the current path of the controlling leg.

Connected in the current path of each of the secondary controlled legs includes a programmable element illustrated as fuses $F_3$, $F_4$ and $F_5$. Connected between the transistors $Q_3$, $Q_4$ and $Q_5$ and the programmable elements $F_3$, $F_4$ and $F_5$ are programming terminals $P_3$, $P_4$ and $P_5$ respectively. Programming current source IP is shown which may be selectively connected to the programming terminals $P_3$, $P_4$ and $P_5$. As is evident from FIG. 1, by applying a current to the programming terminals $P_3$, $P_4$ and $P_5$ and a voltage to reference source 18, the programmable elements $F_3$, $F_4$ and $F_5$ may be selectively programmed. Although fuses are shown for the programmable elements, other types of the programmable elements may be used which have a low initial resistance state and a high or substantially open resistance state. The programming current source IP is not a part of the present circuit, but is connected only during programming.

As is well known for current mirrors, the output current is a function of the input current as defined by the ratio of the current capacity of the controlled legs 22, 23, 24 and 25 to the current capacity of the controlling leg 16. Thus, by selecting which of the controllable legs are in the circuit, a specific ratio of current capacity of the output to input currents can be obtained. Since it is desirable in an integrated circuit to have a specific reference current, the current mirror of FIG. 1 provides a method of assurring a specific reference current in spite of manufacturing tolerances. The current mirror of FIG. 1 provides the desired reference current $I_{REFOUT}$ at the terminal 14 by measuring the reference current $I_{REFIN}$ at the input terminal 12 via sensing terminal 20. The diode D is reverse biased and, thus, the current mirror 10 is not operable with a meter connected at the sensing or measuring terminal 20. Once the input reference current $I_{REFIN}$ is measured, the controlled legs 23, 24 and 25 are programmed to give the desired current ratio such that the output reference current $I_{REFOUT}$ at terminal 14 is the desired reference current.

Preferably, the current carrying capacity of $Q_1$ and $Q_2$ of the controlling legs 16 and the primary controlled leg 22 are equal. The current carrying capacity of the secondary controlling transistors $Q_3$, $Q_4$ and $Q_5$ of secondary controlling legs 23, 24 and 25 are smaller than the current capacity of $Q_1$ or $Q_2$ and vary in a binary weighted fashion. To be more specific, if the current carrying capacity of transistor $Q_1$ and $Q_2$ are in, the current carrying capacity of $Q_3$, $Q_4$ and $Q_5$ are 1, 2 and 4 respectively when "n" is greater than the largest area of the secondary transistors. FIG. 2 provides the ratio of the output reference current $I_{REFOUT}$ to the input reference current $I_{REFIN}$ as a function of the states of the programmable elements $F_3$, $F_4$ and $F_5$.

Although the transistors $Q_1$, $Q_2$, $Q_3$, $Q_4$ and $Q_5$ are shown as MOS transistor, it is obvious that they may be bipolar transistors. Similarly, it should be noted that even though only three secondary controlled transistor legs are shown, any number of legs may be used. The greater number of legs, the finer gradation of variance of the ratio of the output to input current may be obtained. It should also be noted that although a binary weighted ladder is described, any mathematical progression may be used for example but not claimed to exponential, square root, $\mu$-law etc.

From the preceding description of the preferred embodiments, it is evident that the objects of the invention are attained, and although the invention has been described and illustrated in detail, it is to be clearly understood that the same is by way of illustration and example only and is not to be taken by way of limitation. The spirit and scope of the invention are to be limited only by the terms of the appended claims.

What is claimed is:

1. A programmable current mirror circuit comprising:

a controlling transistor having first and second terminals defining a current path and a control terminal, said first terminal being connected to a circuit input terminal, said second terminal being connected to a reference terminal and said control terminal being connected to said first terminal;

a primary controlled transistor having first and second terminals defining a current path and a control terminal, said first terminal being connected to a circuit output terminal, said second terminal being connected non-programmably to said reference terminal and said control terminal of said primary controlled transistor being connected to said control terminal of said controlling transistor; and a plurality of secondary controlled transistors each having first and second terminals defining a current path and a control terminal, said first terminal being connected to said circuit output terminal, said control terminal of said secondary controlled transistor being connected to said control terminal of said primary controlled transistor and programmable means for selectively connecting said second terminal to said reference terminal to determine the match of current at said circuit input terminal and said circuit output terminal.

2. A programmable current mirror circuit according to claim 1, wherein said controlling transistor and said primary controlled transistor have equal current capacity and said secondary controlled transistors each have a current capacity smaller than said current capacity of said primary controlled transistor.

3. A programmable current mirror circuit according to claim 2, wherein said secondary controlled transistors have binary weighted current capacities.

4. A programmable current mirror circuit according to claim 1, including for each programming means a programming terminal for programming said programming means in combination with said reference terminal and connected between said second terminal of said secondary controlled transistor and said programming means.

5. A programmable current mirror circuit according to claim 1, including a sensing terminal connected to said input terminal for sensing current at said input terminal and a diode connected between said sensing terminal and said first terminal of said controlling transistor for disabling said current mirror circuit when current is being sensed at said sensing terminal.

6. A programmable current mirror circuit according to claim 1, wherein said transistors are bipolar transistors with a collector-emitter forming said current path and a base being said control terminal.

7. A programmable current mirror circuit according to claim 1, wherein said transistors are field effect transistors with a source-drain current path and a gate being said control terminal.

8. A method of adjusting a reference current circuit comprising:

providing a current mirror in said reference current circuit having a controlling leg connected to an input reference current terminal and a controlled leg and a plurality of programmable controlled legs connected in parallel to an output reference current terminal;

measuring the input reference current at said input current reference terminal; and adjusting the current capacity of said controlled leg with respect to said controlling leg by programmably connecting selected programmable controlled legs to produce a desired output reference current at said output reference current terminal as a function of said measured input reference current.

9. A method of adjusting a reference current circuit according to claim 8 including providing means to prevent activation of said current mirror during said measuring and said adjusting steps.

10. A method of adjusting a reference current circuit according to claim 8 wherein said programmable controlled legs are provided to have a binary weighted current capacity.

* * * * *